US011505346B2

(12) United States Patent
Schlenker et al.

(10) Patent No.: US 11,505,346 B2
(45) Date of Patent: Nov. 22, 2022

(54) PACKAGING MACHINE FOR PRODUCING CIGARETTE PACKS

(71) Applicant: Focke & Co. (GmbH & Co. KG), Verden (DE)

(72) Inventors: Michael Schlenker, Blender (DE); Henry Buse, Visselhövede (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 149 days.

(21) Appl. No.: 16/770,372

(22) PCT Filed: Dec. 6, 2018

(86) PCT No.: PCT/EP2018/083729
§ 371 (c)(1),
(2) Date: Jun. 5, 2020

(87) PCT Pub. No.: WO2019/110704
PCT Pub. Date: Jun. 13, 2019

(65) Prior Publication Data

US 2021/0171227 A1 Jun. 10, 2021

(30) Foreign Application Priority Data

Dec. 8, 2017 (DE) ..... 102017011309.2

(51) Int. Cl.
*B65B 19/22* (2006.01)
*B65D 85/10* (2006.01)
(Continued)

(52) U.S. Cl.
CPC ..... *B65B 19/228* (2013.01); *B65D 85/1045* (2013.01); *B65B 19/20* (2013.01); *B65B 61/002* (2013.01); *B65B 2230/04* (2013.01)

(58) Field of Classification Search
CPC ..... B65D 85/1045; B65B 19/00; B65B 19/20; B65B 19/223; B65B 19/228; B65B 2230/04; B65B 61/002
See application file for complete search history.

(56) References Cited

U.S. PATENT DOCUMENTS

2005/0082012 A1* 4/2005 Spatafora ..... B65C 9/14 156/249
2007/0101683 A1 5/2007 Bray
(Continued)

FOREIGN PATENT DOCUMENTS

CN 102112378 A 6/2011
CN 104114448 A 10/2014
(Continued)

OTHER PUBLICATIONS

Deutsches Patent—und Markenamt (Germany Patent and Trademark Office), Recherchenbericht (search in a related application), Jul. 11, 2017.
(Continued)

*Primary Examiner* — Andrew M Tecco
*Assistant Examiner* — Nicholas E Igbokwe
(74) *Attorney, Agent, or Firm* — Laurence P. Colton; Smith Tempel Blaha LLC

(57) ABSTRACT

A packaging machine for producing packs with a group of cigarettes as pack content, having individual manufacturing units which are arranged adjacent to one another on a manufacturing line and which are (non-destructively) separable from one another in each case in the region of or along (imaginary) parting planes between them and are removable from the manufacturing line as required, wherein the packaging machine can be converted from a first configuration, in which a first pack type can be manufactured, into a second configuration, in which a second pack type which differs from the first pack type can be manufactured, by removing
(Continued)

at least one separable manufacturing unit from the manufacturing line, by replacing at least one separable manufacturing unit with another separable manufacturing unit and/or by adding at least one further separable manufacturing unit to the manufacturing line.

20 Claims, 10 Drawing Sheets

(51) Int. Cl.
*B65B 19/20* (2006.01)
*B65B 61/00* (2006.01)

(56) References Cited

U.S. PATENT DOCUMENTS

| | | | | |
|---|---|---|---|---|
| 2011/0078980 | A1* | 4/2011 | Pipes | B65B 35/52 53/234 |
| 2011/0114518 | A1* | 5/2011 | Hein | B65B 19/20 206/268 |
| 2012/0241339 | A1* | 9/2012 | Buse | B65B 19/226 206/268 |
| 2014/0151251 | A1* | 6/2014 | Lena | B65D 85/1045 206/268 |

FOREIGN PATENT DOCUMENTS

| | | | | |
|---|---|---|---|---|
| CN | 105000208 | A | 10/2015 | |
| CN | 105857689 | A | 8/2016 | |
| CN | 106315012 | A | 1/2017 | |
| CN | 107406154 | A | 11/2017 | |
| DE | 10115563 | A1 | 10/2002 | |
| DE | 102008010433 | A1 | 8/2009 | |
| DE | 102010023753 | A1 | 12/2011 | |
| DE | 102013009472 | A1 | 12/2014 | |
| DE | 102013011884 | A1 | 1/2015 | |
| DE | 102015001311 | A1 | 8/2016 | |
| DE | 102015001312 | A1 | 8/2016 | |
| DE | 102015110682 | A1 | 1/2017 | |
| DE | 102015016444 | A1 | 6/2017 | |
| DE | 102016001297 | A1 | 6/2017 | |
| DE | 102016003737 | A1 | 10/2017 | |
| DE | 102016009406 | A1 | 2/2018 | |
| EP | 1829783 | A1 | 9/2007 | |
| EP | 2562092 | A1 | 2/2013 | |
| EP | 3053838 | A1 * | 8/2016 | B65B 19/02 |
| WO | 2000075017 | A1 | 12/2000 | |
| WO | 2006032874 | A1 | 3/2006 | |
| WO | 2017001040 | A1 | 1/2017 | |

OTHER PUBLICATIONS

WIPO, International Search Report (on parent application), Apr. 23, 2019.

China National Intellectual Property Administration, Notification of the First Office Action and Search Report (in a related application), May 6, 2021.

* cited by examiner 17
18
19
22
23
24
25
26
27
28
29
30
31
32
33

PACKAGING MACHINE FOR PRODUCING CIGARETTE PACKS

CROSS REFERENCE TO RELATED APPLICATIONS

This application is the US National Phase of and claims the benefit of and priority on International Application No. PCT/EP2018/083729 having a filing date of 6 Dec. 2018, which claims priority on and the benefit of German Patent Application No. 10 2017 011 309.2 having a filing date of 8 Dec. 2017.

BACKGROUND OF THE INVENTION

Technical Field

The present invention relates to a packaging machine for producing packs with a group of cigarettes as pack content, having individual manufacturing units arranged adjacent to one another on a manufacturing line. The invention furthermore relates to a method for converting a packaging machine of said type from a first configuration, in which a first pack type can be manufactured, into a second configuration, in which a second pack type which differs from the first pack type can be manufactured.

Prior Art

In the cigarette packaging sector, particular packs have been of interest for several years. On the one hand, packs in which the cigarette group is almost completely surrounded by a dimensionally stable inner wrapper other than in the region of a removal opening, wherein the removal opening is covered by an in particular reclosable closure flap or a closure label. This inner pack is integrated into a likewise dimensionally stable outer wrapper, for example a hinged carton composed of cardboard. Such a pack is also referred to as a box-in-box pack. Packs have likewise aroused particular interest which, although they also have an inner pack or a tray composed of dimensionally stable material, said inner pack or tray is however in turn firstly integrated into a separate sealing inner pack composed of foil, wherein the sealing inner pack has a removal opening covered by a closure label. The sealing inner pack is in turn integrated in a separate, dimensionally stable outer pack.

Different packaging machines are required for the different embodiments of such packs. This is cumbersome and expensive.

BRIEF SUMMARY OF THE INVENTION

Proceeding from this, it is an object of the present invention to specify a packaging machine of the type mentioned in the introduction, with which different pack types can be manufactured as required. It is furthermore an object of the present invention to specify a method with which a packaging machine of said type can be converted from the production of a first pack type to the production of a second, different pack type.

Said object is achieved by means of a packaging machine for producing packs with a group of cigarettes as pack content, having individual manufacturing units which are arranged adjacent to one another on a manufacturing line and which are (non-destructively) separable from one another in each case in the region of or along (imaginary) parting planes between them and are removable from the manufacturing line as required, wherein the packaging machine can be converted from a first configuration, in which a first pack type can be manufactured, into a second configuration, in which a second pack type which differs from the first pack type can be manufactured, by removing at least one separable manufacturing unit from the manufacturing line, by replacing at least one separable manufacturing unit with another separable manufacturing unit and/or by adding at least one further separable manufacturing unit to the manufacturing line, wherein the packaging machine, in the first configuration, has at least the following in succession in a manufacturing flow direction:

- a separable manufacturing unit for forming cigarette groups—forming unit—,
- a first separable manufacturing unit—first folding unit—in which an inner blank composed of cardboard or of some other material suitable for forming a dimensionally stable (inner) pack is folded around the respective cigarette group so as to form an inner pack,
- in particular adjoining this, a separable manufacturing unit—sealing inner pack unit—in which a sealing inner pack of a first type is formed in each case from the inner pack or in which a sealing inner pack of the first type is folded into a final state or in which in each case one sealing inner pack of the first type comprising the inner pack is formed,
- in particular adjoining this, a second separable manufacturing unit—second folding unit—in which an outer blank composed of cardboard or of some other material suitable for forming a dimensionally stable (outer) pack is in each case folded around the sealing inner pack of the first type in each case so as to form an outer pack, in particular adjoining this, a separable manufacturing unit—curing unit—in which adhesive between folding tabs, which have been adhesively bonded to one another, of the respective outer blank of the outer pack can cure.

Said object also is achieved by means of a method for converting a packaging machine for producing packs with a group of cigarettes as pack content as disclosed herein from the first configuration, in which the first pack type can be manufactured, into a second configuration, in which a second pack type which differs from the first pack type can be manufactured, by virtue of at least one of the separable manufacturing units being removed from the manufacturing line, by virtue of at least one of the separable manufacturing units in the manufacturing line being replaced by another separable manufacturing unit, and/or by virtue of at least one further separable manufacturing unit being added to the manufacturing line.

According thereto, a packaging machine for producing packs with a group of cigarettes as pack content is specified, having individual manufacturing units which are arranged adjacent to one another on an in particular rectilinear manufacturing line and which are (non-destructively) separable from one another in each case in the region of or along preferably vertical (imaginary) parting planes, running in particular perpendicular to the manufacturing line or perpendicular to the manufacturing flow direction, between them and are removable from the manufacturing line as required, wherein the packaging machine can be converted from a first configuration, in which a first pack type can be manufactured, into a second configuration, in which a second pack type which differs from the first pack type can be manufactured, by removing at least one separable manufacturing unit from the manufacturing line, by replacing at least one separable manufacturing unit with another separable manufacturing unit and/or by adding at least one further separable manufacturing unit to the manufacturing line.

The packaging machine, in the first configuration, has at least the following in succession in a manufacturing flow direction:

a separable manufacturing unit for forming cigarette groups—forming unit—, a first separable manufacturing unit—first folding unit—in which an inner blank composed of cardboard or of some other (foldable) material suitable for forming a dimensionally stable (inner) pack is folded around the respective cigarette group so as to form an inner pack, in particular adjoining this, a separable manufacturing unit—sealing inner pack unit—in which a sealing inner pack of a first type is formed in each case from the inner pack or in which a sealing inner pack of the first type is folded into a final state or in which in each case one sealing inner pack of the first type comprising the inner pack is formed, in particular adjoining this, a second separable manufacturing unit—second folding unit—in which an outer blank composed of cardboard or of some other foldable material suitable for forming a dimensionally stable (outer) pack is in each case folded around the sealing inner pack of the first type in each case so as to form an outer pack, in particular adjoining this, a separable manufacturing unit—curing unit—in which adhesive arranged between folding tabs, which have been adhesively bonded to one another, of the respective outer blank of the outer pack can cure.

"Curing" is to be understood to mean all types of physical or chemical curing. These include, in the case of water or other solvent-containing adhesives, the drying thereof or, in the case of hotmelt adhesive, the setting etc. thereof.

Preferably, the separable manufacturing units each have at least one dedicated servomotor for driving at least one movable member of the manufacturing unit or of the manufacturing units, preferably for driving all movable members, which are to be driven, of the manufacturing unit(s), in particular for driving at least one conveying member.

Alternatively, in each case one common servomotor of this type may be assigned to several of the separable manufacturing units, in particular in each case at most two or three of the separable manufacturing units.

Preferably, at least two separable manufacturing units are assigned in each case one common servomotor for driving movable members of the manufacturing units, wherein only one of these separable manufacturing units has the servomotor, and wherein at least one movable member of the separable manufacturing unit which does not have the servomotor is connected via a transmission to the servomotor of the other separable manufacturing unit which has the servomotor.

It is furthermore preferable if at least two or all of the separable manufacturing units in each case exclusively have housings or casings which are assigned only to them, and which in particular do not extend into the region of the manufacturing unit that is respectively adjacent on the manufacturing line.

In a further preferred embodiment of the invention, the packaging machine, in the second configuration, has at least the following in succession in a manufacturing flow direction:

the separable forming unit, the first separable folding unit, in particular adjoining this, instead of the separable sealing inner pack unit for forming the sealing inner pack of the first type, another separable sealing inner pack unit for forming a sealing inner pack of a second type which differs from the first, in particular adjoining this, the second separable folding unit, in which in each case one outer blank composed of cardboard or of some other material suitable for forming a dimensionally stable (outer) pack is folded around the sealing inner pack of the second type, in particular adjoining this, the separable curing unit.

In a further preferred embodiment of the invention, the packaging machine, in the second configuration, has at least the following in succession in a manufacturing flow direction:

the separable forming unit, adjoining this, a separable manufacturing unit—wrapping unit—in which a blank composed of wrapping material, in particular foil material or (coated) paper, for example tin foil or aluminum-laminated paper, is folded around the cigarette group so as to form a wrap which entirely or partially surrounds the cigarette group, adjoining this—after removal of the first separable folding unit, and after removal of the separable sealing inner pack unit for forming a sealing inner pack of the first type—the second separable folding unit, in which an outer blank composed of (thin) cardboard or of some other material suitable for forming a dimensionally stable (outer) pack is folded around the cigarette group, which is partially or completely surrounded by the wrapping material blank, so as to form an outer pack, adjoining this, the separable curing unit.

In a further preferred embodiment of the invention, between the separable forming unit and the first separable folding unit, in particular adjoining each of these, there is arranged a separable manufacturing unit—transfer unit—which conveys the respective cigarette groups from the separable forming unit to the first separable folding unit.

In a further preferred embodiment of the invention, the separable transfer unit additionally completely or partially wraps the cigarette groups in a blank composed of wrapping material, in particular foil material or (coated) paper, such as tin foil or aluminum-laminated paper, in particular in such a way that the respective wrapping material blank is folded in a cup-like or U-shaped manner around the respective cigarette group, such that the wrapping material blank does not cover the filters of the cigarettes at least in their end region.

In a further preferred embodiment of the invention, in the region of or along the parting plane between in each case two separable manufacturing units, in each case one conveying member of one separable manufacturing unit is arranged adjacent to a conveying member of the other separable manufacturing unit, specifically such that the respective cigarette groups can be transferred from one conveying member to the other conveying member.

In a further preferred embodiment of the invention, the first and/or the second folding unit comprises a folding revolver which folds the inner blank around the cigarette group so as to form the inner pack and/or which folds the outer blank in each case around the sealing inner pack so as to form the outer pack.

In a further preferred embodiment, the plane of rotation of the folding revolver of the first separable folding revolver unit and/or the plane of rotation of the folding revolver of the second separable folding revolver unit is arranged horizontally.

In a further preferred embodiment of the invention, the first separable folding unit and the second separable folding unit are of (substantially) identical form.

In a further preferred embodiment of the invention, the separable sealing inner pack unit has a turning device which rotates the respective inner or sealing inner pack with the cigarette group integrated therein—in particular within the conveying plane in which the cigarette group is conveyed in the region of the turning device, or within a plane parallel thereto—in particular through 180°, possibly in individual partial rotations, preferably in a horizontal plane.

Alternatively, it may also be provided that the respective inner or sealing inner pack is rotated in two or more individual rotations in such a way that a 0° rotation occurs overall in relation to the conveying path along which the inner or sealing inner pack is conveyed in the region of the turning device. This occurs for example in that, firstly, a first rotation (for example 90°) is performed in a first direction of rotation, and subsequently a second rotation of the same magnitude is performed in a second, opposite direction of rotation (for example −90°).

In a further preferred embodiment of the invention, the sealing pack unit has a conveying device which conveys the respective inner or sealing inner pack, with cigarettes oriented parallel to the conveying direction, into the region of the turning device, in particular along a rectilinear conveying path of the conveying device.

In a further preferred embodiment of the invention, the sealing inner pack is in each case a separate pack, sealed on all sides and in particular (partially) composed of foil with a removal opening covered by a closure label, which completely envelops the respective inner pack together with the cigarette group.

Alternatively, the sealing inner pack is a pack in each case sealed on all sides and formed or created from the respective inner pack, in the case of which one or each opening of the inner pack is covered over its entire area with a label, in particular a closure label.

In a further preferred embodiment of the invention, the or each label which covers the opening is applied to the inner pack in the separable sealing inner pack unit, preferably after or downstream of a (possibly first partial) rotation of the inner pack by the turning device.

In a further preferred embodiment of the invention, the inner blank which is folded around the cigarette group in the first separable folding unit is, already before the folding process, provided with a closure label which is arranged so as to cover a removal opening of the subsequent sealing inner pack.

In a further preferred embodiment of the invention, the curing device has a conveying device with a conveying path which runs perpendicular to the in particular rectilinear conveying path of the conveying device of the sealing inner pack unit and which in particular is likewise rectilinear and along which the outer packs are conveyed, in particular are discharged out of the packaging machine.

The method according to the invention is distinguished by the fact that the packaging machine is converted from the first configuration, in which the first pack type can be manufactured, into a second configuration, in which a second pack type which differs from the first pack type can be manufactured, by virtue of at least one of the separable manufacturing units from the manufacturing line, by virtue of at least one of the separable manufacturing units in the manufacturing line being replaced by another separable manufacturing unit, and/or by virtue of at least one further separable manufacturing unit being added to the manufacturing line.

In a refinement of this concept, the packaging machine is converted into the second configuration by virtue of the separable sealing inner pack unit for the formation of the sealing inner pack of the first type being removed from the manufacturing line and being replaced by another separable sealing inner pack unit for the formation of a sealing inner pack of the second type, which differs from the first.

BRIEF DESCRIPTION OF THE DRAWINGS

Further features of the present invention will emerge from the appended patent claims and from the following description of preferred exemplary embodiments of the invention. In the figures:

DETAILED DESCRIPTION OF PREFERRED EMBODIMENTS

Figure 7:
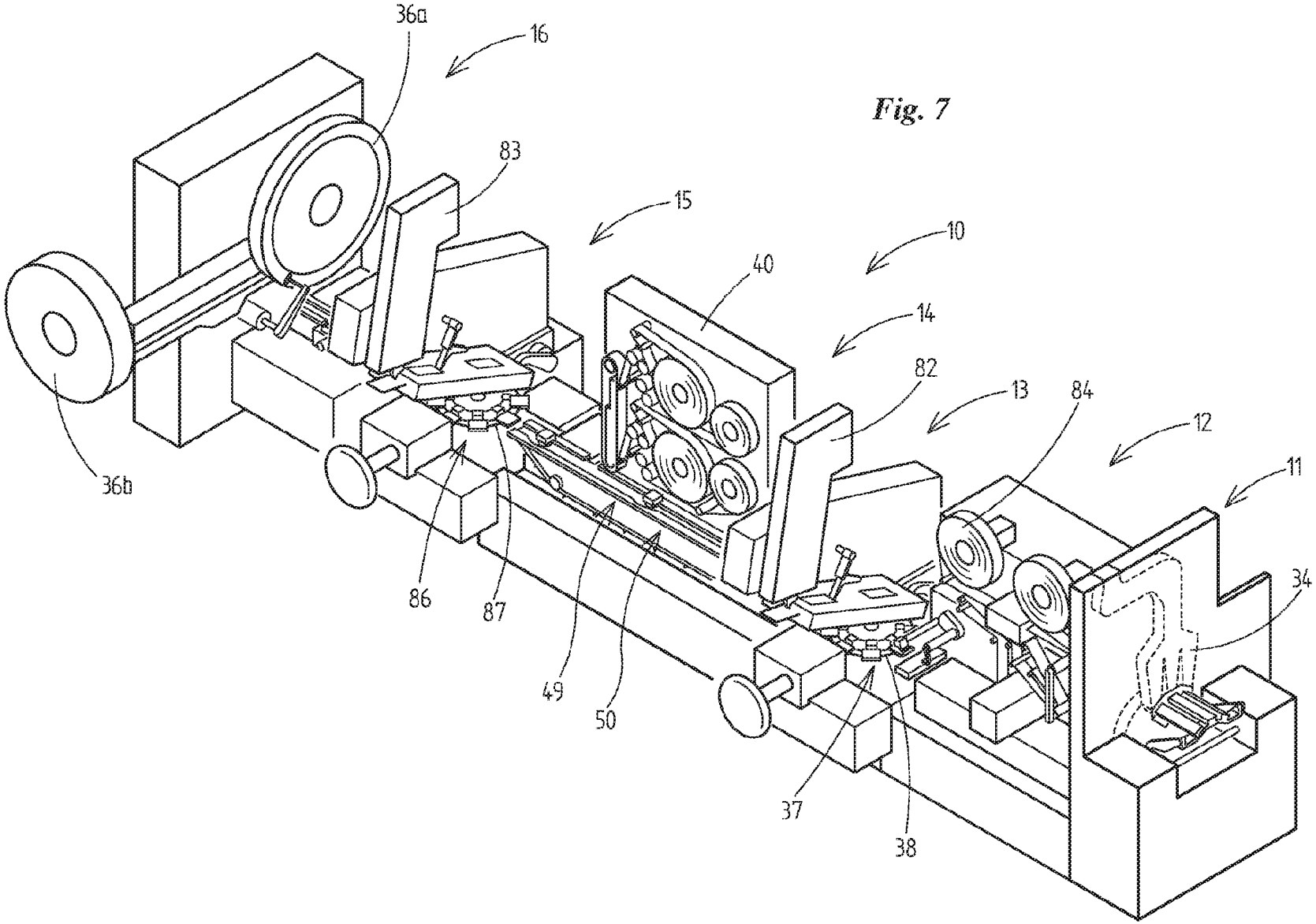
FIG. 7 shows the packaging machine from FIG. 6 in a/the configuration in which it is suitable for producing a box-in-box pack corresponding to FIG. 4.
Figure 8:
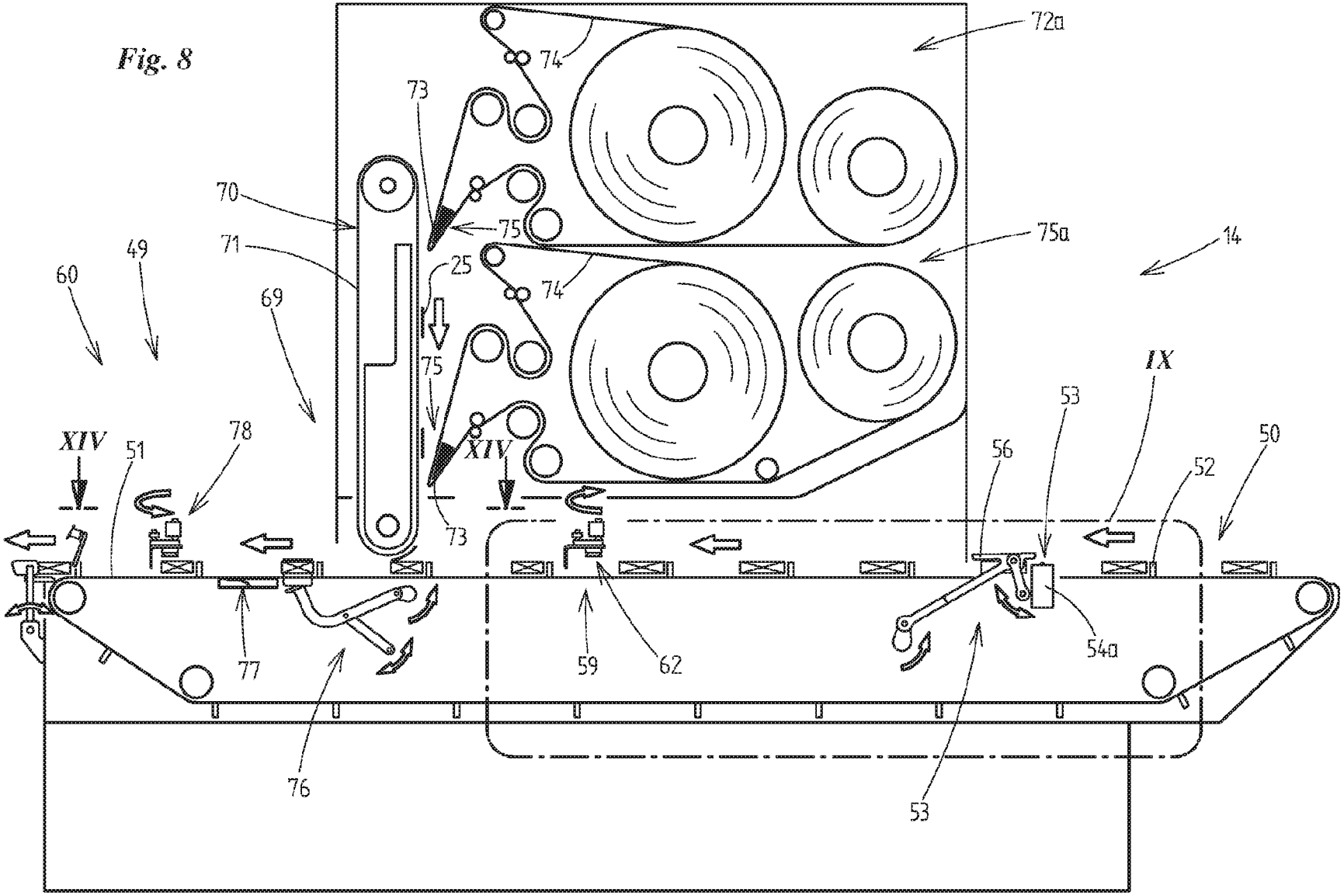
FIG. 8 shows a side view of a separable sealing inner pack unit of the packaging machine corresponding to the configuration from FIG. 7.
Figure 9:
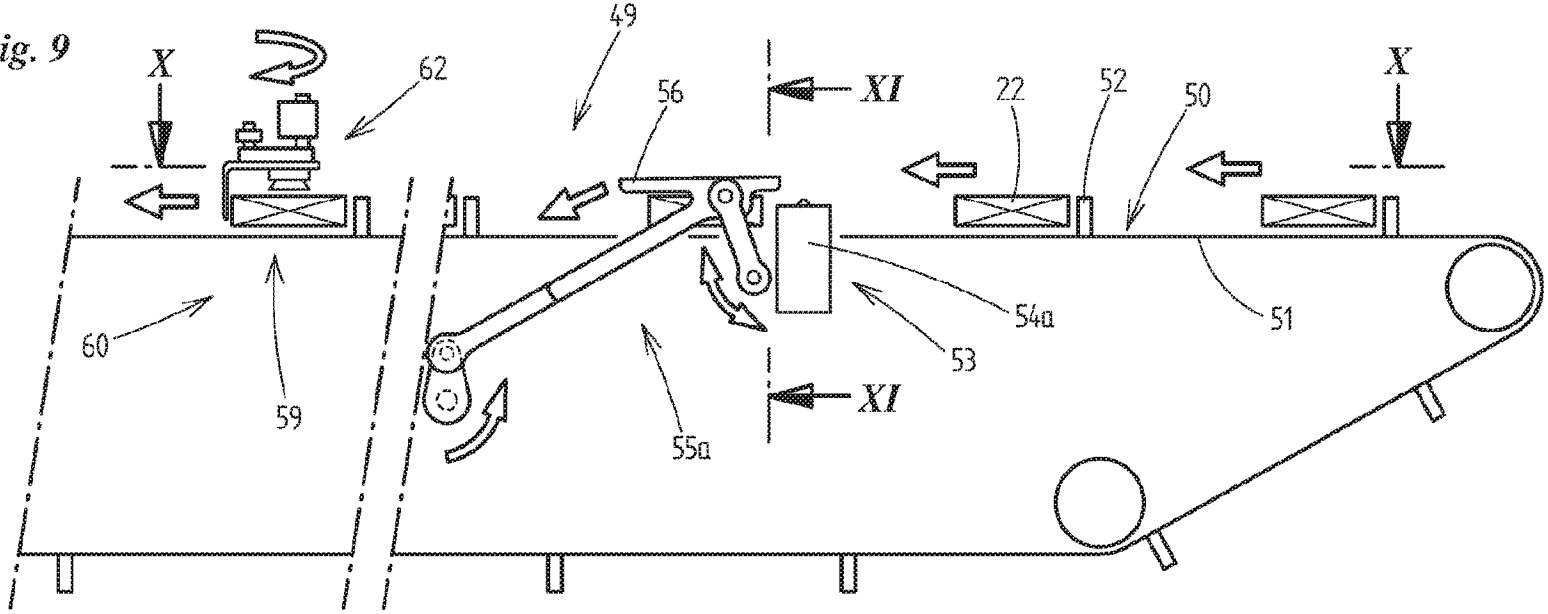
FIG. 9 shows the detail IX from FIG. 8 in an enlarged illustration.
Figure 10:
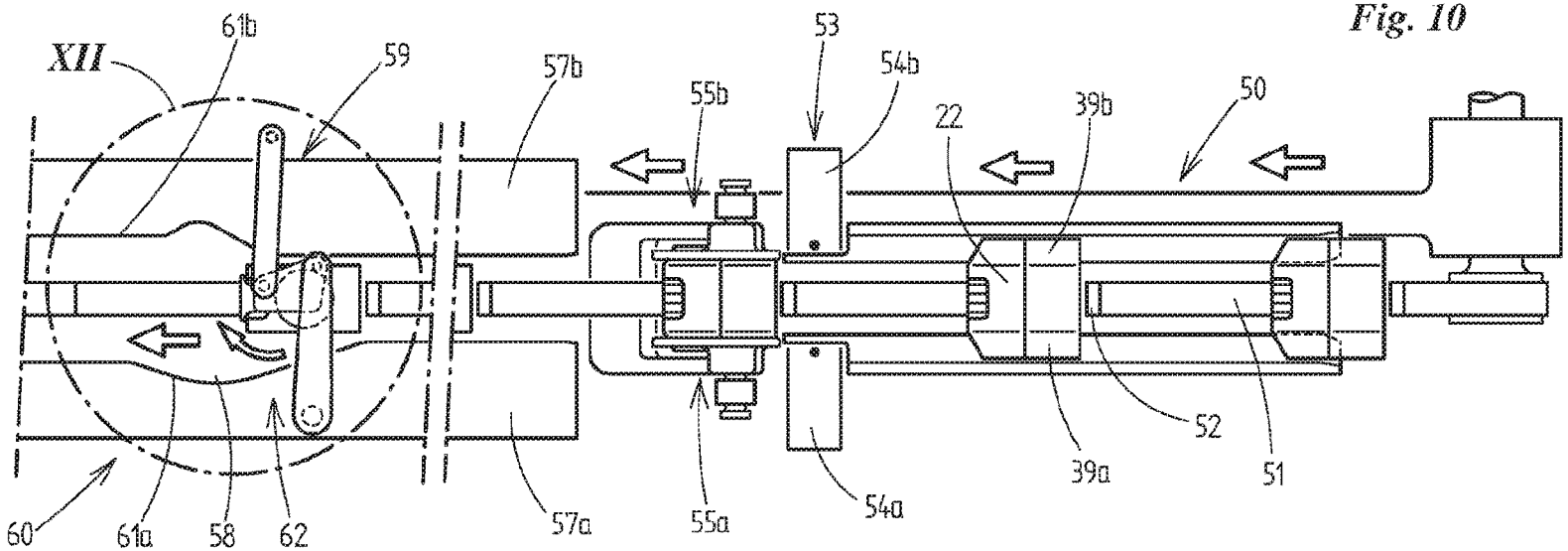
FIG. 10 shows a plan view corresponding to the arrow direction X in FIG. 9.
Figure 11:
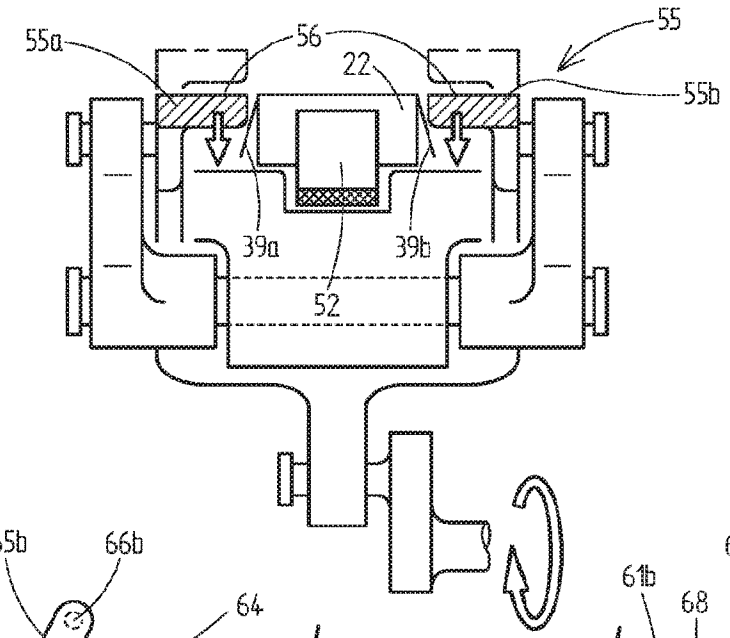
FIG. 11 shows a cross section through the detail of FIG. 9 along the cross-section line XI-XI.

A packaging machine 10 according to the invention for producing cigarette packs has, in a first configuration, individual separable manufacturing units 11-16 which are arranged adjacent to one another in a manufacturing line, cf. FIG. 7.

Figures 3, 4, 5:
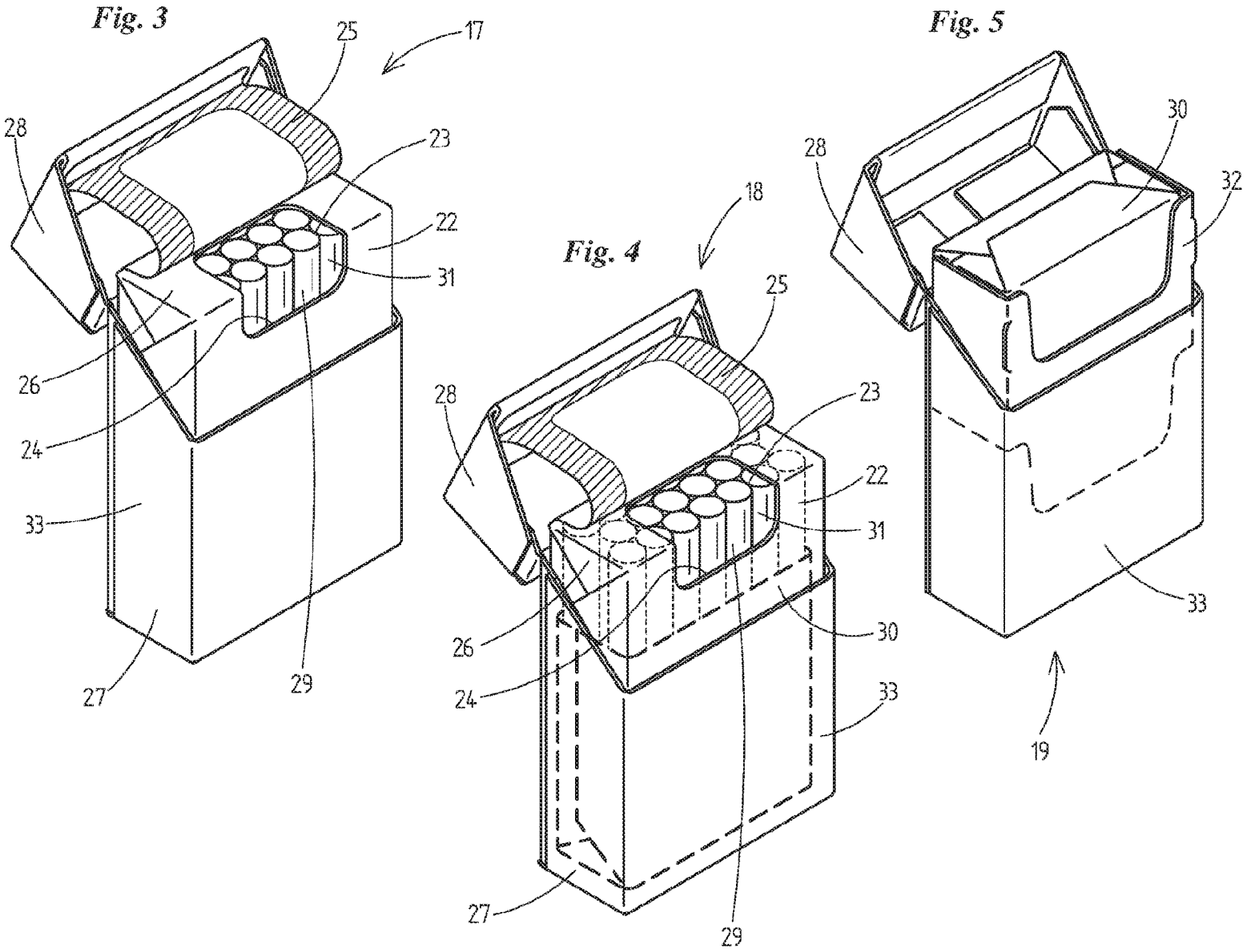
FIG. 3 shows an oblique view of a so-called box-in-box pack, producible in a first configuration of the packaging machine.
FIG. 4 shows the cigarette pack from FIG. 3, but additionally with an innermost wrapping material or tin foil wrapper of the cigarette group, which partially surrounds the cigarette group, producible in a further configuration of the packaging machine.
FIG. 5 shows a standard hinged carton, wherein a wrapping material or tin foil wrapper completely surrounds the cigarette group, producible in a further configuration of the packaging machine according to the invention.

In the configuration as per FIG. 7, it is possible inter alia to produce the pack type 18, "box-in-box with tin foil/wrapping material partial wrapper" illustrated in FIG. 4.

The packaging machine 10 can be easily converted into other configurations in which it is in each case possible to produce inter alia the pack types 17, "box-in-box without tin foil/wrapping material partial wrapper", and 19, "standard hinge lid with complete tin foil/wrapping material wrapper", illustrated in FIGS. 3 and 5.

Furthermore, the packaging machine 10 can be converted into configurations in which so-called sealed bundle packs can be produced. On the one hand, sealed bundle packs 20, cf. FIG. 18, with so-called envelope folding, and sealed bundle packs 21 as flow wrap packs.

The present exemplary embodiments of the configurations of the packaging machine 10 concentrate, without being restrictive, primarily on the production of the aforementioned pack types 17-19.

These are constructed as follows:

In the substantially cuboid box-in-box pack 17, an inner pack 22 composed of dimensionally stable, foldable material, in particular (thin) cardboard or (relatively thick) paper, surrounds a formed cigarette group 23. The inner pack 22 has a removal opening 24 in the upper region for the removal of the cigarettes 29 from the cigarette group 23, which removal opening is closed by a closure label 25 in the closed state of the pack 17.

The closure label 25 is preferably provided with a glue which enables the closure label 25 to be used, or closed and opened, several times.

The closure label 25 forms, together with the inner pack 22, a sealing inner pack 26 which seals off the cigarette group 23 to the outside.

The sealing inner pack 26 is seated in a separate outer pack 27 composed of likewise dimensionally stable material, in particular (thin) cardboard or (relatively thick) paper. In the present case, the outer pack 27 is designed as a so-called hinged-carton or hinge-lid pack. It may alternatively also be designed as a shoulder box or sliding-sleeve pack or some other pack type made of dimensionally stable material.

The closure label 25 is attached in one end region to a pivotable lid part 28 of the outer pack 27, such that, when the lid part 28 is opened relative to a cup-shaped carton part 33 which can be closed by means of the lid part 28 and to which the lid part 28 is pivotably attached, the closure label 25 is automatically moved from a/the closure position, in which it covers the removal opening 24, into a position illustrated in FIG. 3, in which it opens up the removal opening.

This however does not have to be the case. It is also conceivable for the closure label 25 not to be attached to the cover part 28. In this case, the closure label 25 would have a handling section that allows a user to pull the closure label 25 upward by hand in order to open up the removal opening 24.

The pack 18 as per FIG. 4 is substantially identical to the pack 17, such that corresponding parts are denoted by the same reference designations. However, the cigarette group 23 in the pack 18 is additionally partially directly wrapped in a cup-like wrap 30, specifically with the filters 31 of the cigarettes 29 being at least partially, preferably completely, exposed.

In the present case, the wrap or wrapper 30 is composed of tin foil. It is however also possible for other wrapping materials to be used, such as for example (aluminum-laminated) paper.

By means of this wrap 30, it is for example possible for flavorings, such as for example menthol or the like, to be introduced into the cigarettes 29, the wrap 30 being impregnated with these flavorings for this purpose.

The cigarette pack 19 as per FIG. 5 is a conventional hinged-carton or hinge-lid pack. Here, the outer pack 27 corresponds to that of the packs 17, 18. However, the cigarette group 23 (not visible) is not integrated into a dimensionally stable inner pack, but is rather merely surrounded, specifically completely, by a wrap 30.

The material of the wrap 30 of the pack 19 may also be tin foil, aluminum-laminated paper or some other suitable wrapping material. The cigarette pack 19 furthermore has a collar 32 in a known manner.

Figure 6:
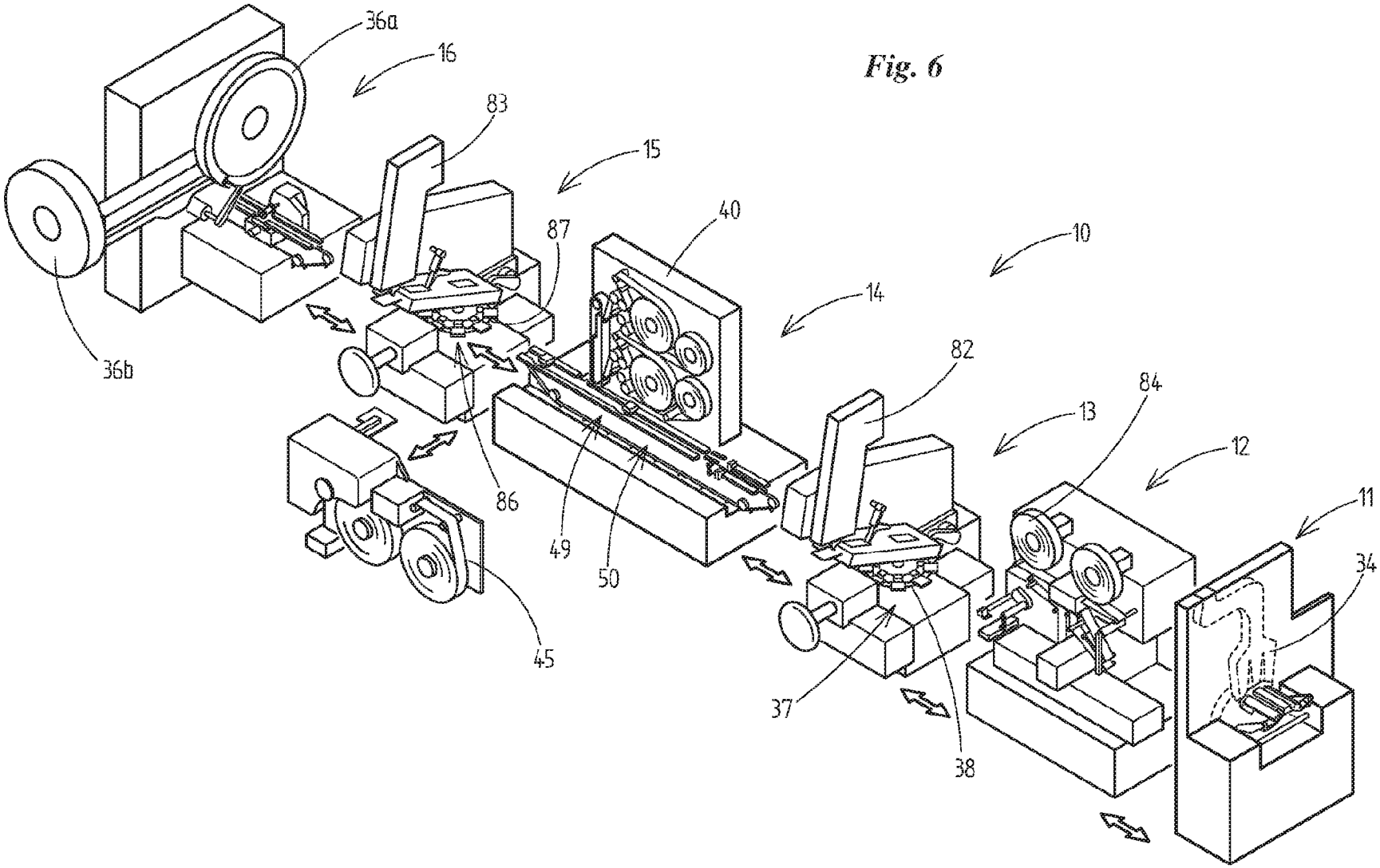
FIG. 6 shows all separable manufacturing units of the packaging machine in an oblique view, in each case spaced apart from one another for the sake of clarity.

The individual separable manufacturing units 11-16 of the packaging machine 10 are non-destructively separable from one another in the region of (imaginary) parting regions or (in particular vertical) parting planes between in each case two adjacent separable manufacturing units 11-16. FIG. 6 shows the manufacturing units 11-16 in a separated state. Respectively adjacent manufacturing units 11-16 have a gap between them, whereas they adjoin one another in each case in FIG. 7.

As indicated above, the packaging machine 10 can assume different configurations or can be converted to a different configuration in each case.

Below, a description will firstly be given of the main functions of the individual separable manufacturing units 11-16 of the packaging machine 10.

With the machine configuration as per FIG. 7, box-in-box packs 18 with a partial wrap 30 can be manufactured.

In the separable manufacturing unit 11—forming unit—individual cigarettes 29 originating from a cigarette magazine 34 are formed into cigarette groups 23 (in general, a cigarette group is composed of three layers of cigarettes arranged one above the other, though there may also be more or fewer) and subsequently transferred to the separable manufacturing unit 12.

The separable manufacturing unit 12 is a transfer unit, the function of which is to transfer the cigarette groups 23 to the subsequent adjacent separable manufacturing unit, specifically a first separable folding unit 13.

Figure 18:
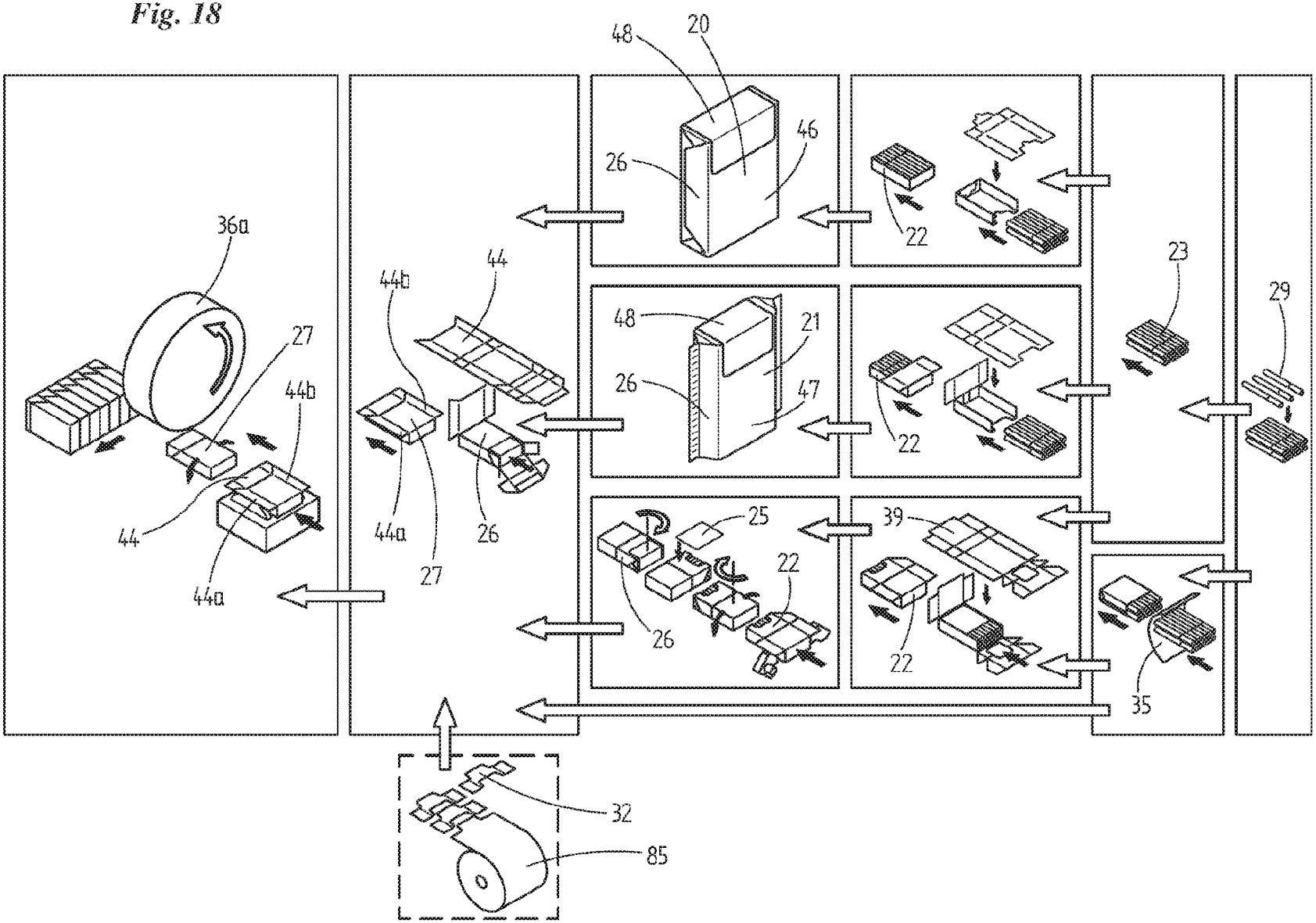
FIG. 18 shows an overview of various main handling steps in further alternative configurations of the packaging machine in which, instead of box-in-box packs, so-called sealed bundle packs with envelope folding or flow-wrap packs can be manufactured.

The separable transfer unit 12 furthermore provides the cigarette groups 23 with a or the wrap 30. For this purpose, blanks 35 are in this case cut from a wrapping material bobbin 84, and in each case one blank 35 for such a wrap 30, cf. also FIG. 18, is folded around the cigarette group 23.

If such a wrap 30 is not desired, for example because the box-in-box packs 17 are to be manufactured without a wrap, the separable transfer unit 12 can be replaced with another transfer unit, in the case of which the corresponding apparatuses for providing the cigarette group 23 with the wrapper 30 are omitted.

Alternatively, it would also be possible for this purpose for the separable transfer unit 12 to be removed from the packaging machine 10 without substitution, and for the separable production units 11, 13 to be brought directly together in the parting regions or parting planes. The cigarette groups 23 would then be conveyed directly from the forming unit 11 to the first folding unit 13.

It is once again alternatively also conceivable for the separable transfer unit 12 to be designed such that, as required, either the cigarette groups 23 are provided with the wrapper 30 or the cigarette groups 23 are conveyed onward without further measures to the first folding unit 13. The cigarette group 23 may then be conveyed either with or without a wrap 30 to the first folding unit 13.

In the separable first folding unit 13, in the configuration of FIG. 7, the inner pack 22 is formed by virtue of in each case one inner blank 39, which originates from a blank magazine 82 and which is suitable for forming the inner pack 22 (composed of cardboard or the other dimensionally stable material), being folded around the respective cigarette group 23.

For this purpose, the separable first folding unit 13 has a folding device 37 which comprises inter alia a folding revolver 38, in the present case rotating in a horizontal plane.

Figure 1:
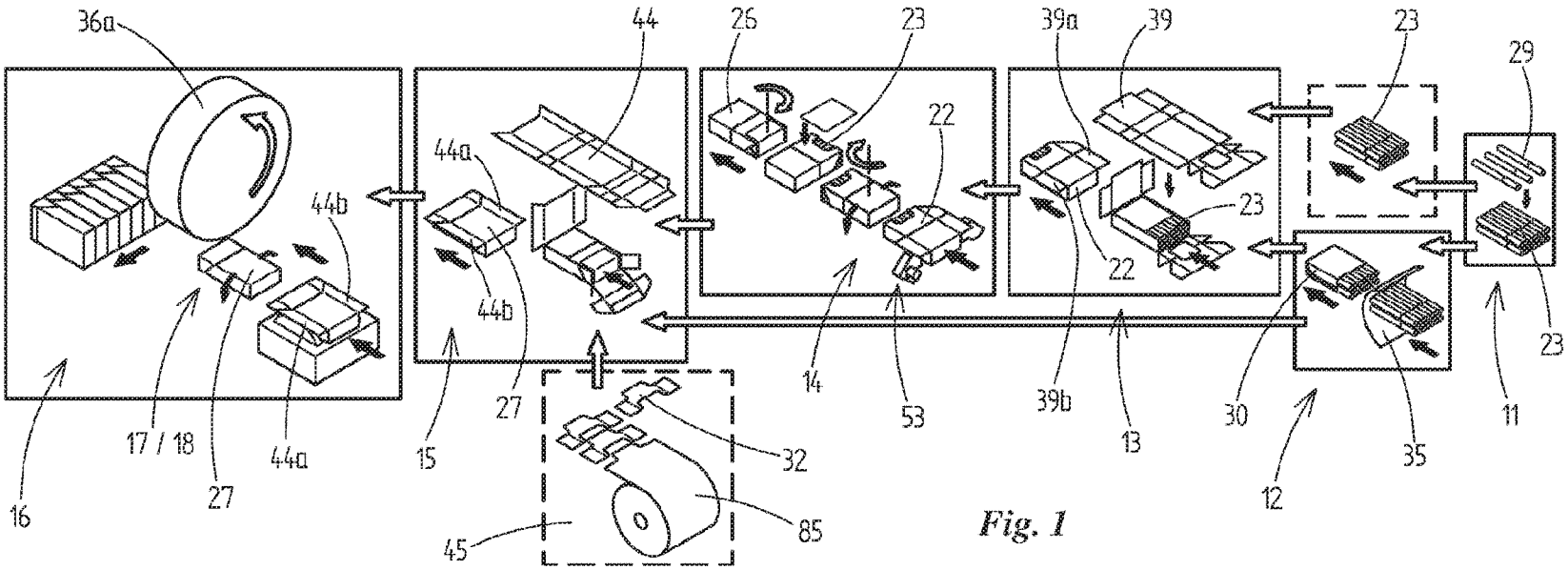
FIG. 1 schematically shows main handling steps that take place in different configurations of an embodiment of the packaging machine according to the invention.
Figure 2:
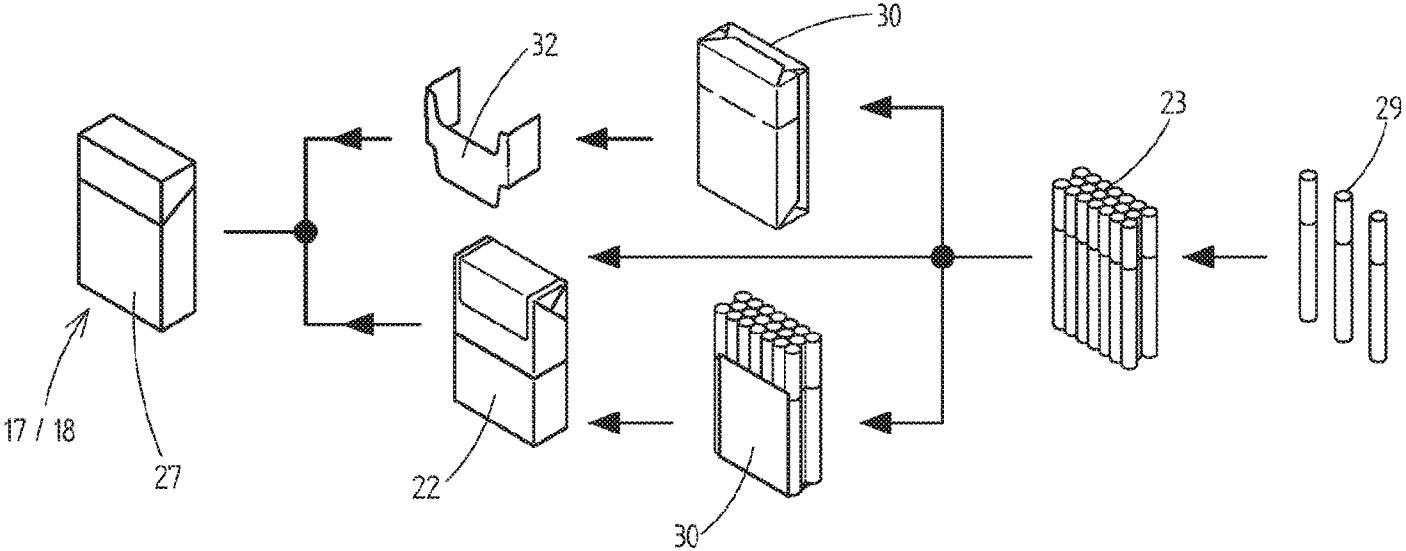
FIG. 2 is a schematic illustration of individual manufacturing steps of different pack types that can be manufactured in different configurations of the packaging machine.

In the first separable folding unit 13, cf. also FIG. 1, the cigarette group 23 (possibly together with the wrap 30) is integrated into an inner blank 39 which is held ready, said inner blank being folded around the cigarette group 23 by means of suitable folding members in order to form the inner pack 22.

In the present exemplary embodiment, the inner pack 22 formed is folded substantially into a final state, aside from two side tabs 39*a*, 39*b* which protrude (in a horizontal plane), in the first separable folding unit 13.

The side tabs 39*a*, 39*b* are folded into a final state and glued only in the next, adjoining separable manufacturing unit 14 in the manufacturing flow direction.

This separable manufacturing unit 14 to which the inner packs 22 are conveyed after their partial completion is a separable sealing inner pack unit, in which a or the sealing inner pack 26 is formed or manufactured in each case from the inner pack 22.

For this purpose, in particular, cf. also FIG. 1, the closure label 25 is in each case applied by means of a labeling appliance 40 to the removal opening 24 of the respective inner pack 22.

Furthermore, the separable sealing inner pack unit 14 comprises a turning device 60 which rotates the respective inner pack 22 or the sealing inner pack 26 manufactured from the inner pack 22 in two steps through in each case 90°, and thus through a total of 180°, relative to a conveying path 50 of a conveying device 49 of the separable sealing inner pack unit, along which the inner packs 22 are each conveyed.

Before this, the side tabs 39*a*, 39*b* of the inner pack 22 which have not yet been folded into the final state in the separable sealing inner pack unit 14 are provided with glue and folded into a final state.

The further details in this regard will be discussed more specifically further below.

The sealing inner packs 26 manufactured from the inner packs 22 by the separable sealing inner pack unit 14 are then transferred to a separable second folding unit 15.

In the separable second folding unit 15, an outer blank 44 composed of cardboard (or another suitable dimensionally stable material, cf. above) and originating from a blank magazine 83 is folded around the sealing inner pack 26, in each case so as to form the outer packs 27, cf. also FIG. 1. For this purpose, the separable second folding unit 15 has a folding device 86 which comprises inter alia a folding revolver 87, in the present case rotating in a horizontal plane. In the second separable folding unit 15, the sealing inner pack 26 is accordingly integrated into an outer blank 44 which is held ready, said outer blank being folded around the cigarette group 23 by means of suitable folding members in order to form the outer pack 27.

Here, the outer pack 27 is, similarly to the inner pack 22, folded substantially into a final state, aside from two side tabs 44*a*, 44*b* which protrude laterally (in a horizontal plane), in the separable second folding unit 15.

In this state, having been folded substantially into a final state, with protruding side tabs 44*a*, 44*b*, the outer packs 27 are conveyed onward to the separable manufacturing unit 16, specifically a separable curing unit.

One of the main functions of the separable curing unit 16 is to allow the curing of adhesive arranged between folding tabs of the inner pack 22 and/or of the outer pack 27, and possibly of the wrap 30, which have been adhesively bonded together. For this purpose, the conveying device may for example have two curing revolvers, in particular drying wheels or revolvers 36*a*, 36*b*.

Additionally, in the present case, the side tabs 44*a*, 44*b* have glue or adhesive applied to them, and are folded into a final state, in the separable curing unit 16, cf. also FIG. 1.

As already indicated above, the packaging machine 10 can, for example, be converted from the configuration shown in FIG. 7 into another configuration, in which a different pack type can be produced.

For example, into a configuration in which the box-in-box pack 17 can be produced by virtue of the transfer unit 12, which also manufactures the wrap 30, being replaced with the transfer unit (not illustrated) which does not manufacture such a wrap 30 and which transfers or conveys the cigarette groups 23 without the wrapper from the forming unit 12 to the separable first folding unit 13.

Proceeding from the configuration of FIG. 7, the packaging machine 10 can also be converted into a configuration in which the cigarette packs 19, that is to say the conventional hinge-lid packs, are manufactured. For this purpose, the first separable folding unit 13 can be removed from the manufacturing line. The same applies to the sealing inner pack unit 14. The transfer unit 12, which is in particular also referred to in this case as wrapping unit, in which a blank composed of wrapping material, in particular foil material or (coated) paper, such as tin foil or aluminum-laminated paper, is then folded around the cigarette group 23 to form a wrap 30 which completely or partially surrounds the cigarette group 23, and the forming unit 11 are then brought into a position directly adjacent to second separable folding unit, so that the gaps left by the first separable folding unit 13 and the sealing inner pack unit 14 are filled.

In this case, a further separable manufacturing unit 45 shown in FIG. 6 is additionally added to the manufacturing line, specifically a separable collar unit 45.

This separable collar unit 45 is then integrated into the manufacturing flow of the packaging machine 10 in the region of the separable second folding unit 15. In the collar unit 45, individual collars 32 (composed of cardboard or some other dimensionally stable material) are cut from a collar material web 85, cf. also FIG. 1, and placed onto the respective block composed of cigarette group 23 and wrap 30.

Proceeding from the configuration of FIG. 7, the packaging machine 10 can also be converted into a configuration in which the sealed bundle packs 20, 21 are manufactured, cf. FIG. 18.

In this case, the separable sealing inner pack unit 14 from FIG. 7 would have to be removed and replaced by another separable sealing inner pack unit (not shown), which produces a corresponding foil wrapper 46 or 47, cf. FIG. 18, into which the respective inner packs 22 are integrated, specifically in each case with a closure label 48 attached to a removal opening of the foil wrapper 46, 47. The functional groups that another separable sealing inner pack unit of said type would have to have for this purpose are known.

The separable sealing inner pack unit 14, by means of which the sealing inner packs 26 are manufactured or formed from the inner packs 22 correspondingly to the configuration from FIG. 7 for manufacturing the box-in-box packs 17 or 18, is formed in a special manner:

The conveying device 49 of the separable sealing inner pack unit 14 has an (endless) conveying belt 51 (toothed belt) with individual, spaced-apart drivers 52.

The drivers 52 delimit receptacles for the inner packs 22. The rectilinear conveying path 50 of the conveying device 49, along which the inner packs 22 or, subsequently, the sealing inner packs 26 formed therefrom are conveyed, extends along the entire sealing inner pack unit 14, specifically between the two parting planes, which are adjoined in each case on one side by the first folding unit 13 and on the other side by the second folding unit 15.

A glue-applying unit 53 for applying glue to the side tabs 39*a*, 39*b* is arranged in a first region of the conveying path 50 in a manufacturing flow direction. The inner packs 22 are fed to the glue-applying unit 53 with cigarettes 29 oriented parallel to the conveying direction, specifically in the present case with filters 31 situated at the front in the conveying direction. In this orientation, they have been conveyed out of the folding revolver 38 of the first separable folding unit 13 and transferred onto the conveying path 50.

The glue-applying unit 53 has in each case a glue valve 54*a*, 54*b* to/at each side of the conveying path 50. By means of the glue-applying unit 53, glue, in particular hot melt, is applied to the inner packs 22 conveyed along the glue-applying unit 53, specifically (from below) to the laterally protruding side tabs 39*a*, 39*b*.

A side tab folding unit 55 is arranged immediately downstream of the glue-applying unit 53 (downstream in the manufacturing flow). With the side tab folding unit 55, the side tabs 39*a*, 39*b* are folded (downward) and brought into their final position, specifically are folded onto, or laid against, further side tabs of the inner pack 22 which are already situated in a final position.

For this purpose, the side tab folding unit 55 has in each case one motor-driven, movable side tab folding member 55*a* or 55*b* at/to both sides of the conveying path 50.

The side tab folding members 55*a*, 55*b* move in (vertical) planes which are perpendicular to the (horizontal) conveying plane of the inner packs 22 and perform reciprocating movements there. In particular, in such a way that in each case one folding part 56 of the respective side tab folding member 55*a*, 55*b* is, during the folding process, guided from above against the side tabs 39*a*, 39*b* and pivoted downward while in contact with said side tabs or so as to drive said side tabs along. There are self-evidently also other possibilities for folding the folding tabs 39*a*, 39*b*.

The conveying device 49 has, along the conveying path 50, lateral guides 57*a*, 57*b* with different sections. Each lateral guide 57*a*, 57*b* has an associated (in particular vertical) guide surface 61*a*, 61*b*. The guide surfaces 61*a*, 61*b* are situated opposite one another with a spacing.

In order to hold the side tabs 39*a*, 39*b* folded by means of the side tab folding unit 55 in position while the respective inner packs 22 are conveyed onward, the lateral guides 57*a*, 57*b* or the guide surfaces 61*a*, 61*b* downstream of the side tab folding unit 55 are initially arranged parallel to one another, specifically with a spacing to one another which approximately corresponds to the pack width of the inner pack, that is to say to the spacing between the narrow longitudinal sides (formed by the side tabs 39*a*, 39*b* and the further side tabs) of the inner pack 22, as far as a first turning location 58.

The inner packs 22 are guided along this section of the lateral guides 57*a*, 57*b* as far as the turning location 58, which is part of a first turning station 59 of a turning device 60.

In the first turning station 59, the inner packs 22 are turned in each case through 90°, such that the cigarettes 29 previously oriented parallel to the conveying direction in the inner packs 22 are subsequently oriented transversely with respect to the conveying direction.

In order to create space for this turning process, the lateral guides 57*a*, 57*b* widen in the area of the turning location 58, or the spacing between the guide surfaces 61*a*, 61*b* is increased in the region of the turning location 58 in relation to the section immediately upstream of the lateral guides 57*a*, 57*b*.

For this purpose, the guide surfaces 61*a*, 61*b* of the lateral guides 57*a*, 57*b* each run outward (away from one another) in a curved manner in the region of the turning location 58.

Following the turning location 58 (downstream thereof), the lateral guides 57*a*, 57*b* or guide surfaces 61*a*, 61*b* thereof again run parallel in a further section, but with a spacing which is slightly greater than that in the section upstream of the turning location 58 and which approximately corresponds to the length of the inner pack 22 (spacing between the base bottom side and lid top side).

The turning device 60 or the first turning station 59 has, in the region of the turning location 58, a turning appliance 62 by means of which the respective inner pack 22 is turned or rotated through 90° relative to the conveying path 50. For this purpose, the turning unit 62 has a holding member 63, the holding forces of which can be controlled, in particular activated and deactivated. In the present case, a controllable suction member which can be charged with negative pressure.

The holding member 63, the holding forces of which can be activated and deactivated, can be moved by means of a motor.

For this purpose, the holding member 63 is in the present case connected to a pivot lever mechanism 64 with a first pivot lever 65*a* and a second pivot lever 65*b*. The two pivot levers 65*a*, 65*b* are each rotatable at one end about axes of rotation 66*a*, 66*b* running perpendicular to the conveying plane of the inner packs 22.

The other ends of the pivot levers 65*a*, 65*b* are rotatably articulated on a support part (support plate) 67 which is arranged, in the region of the turning location 58, above the conveying belt 51. The holding member 63 is fastened to this support part 67.

Figure 12:
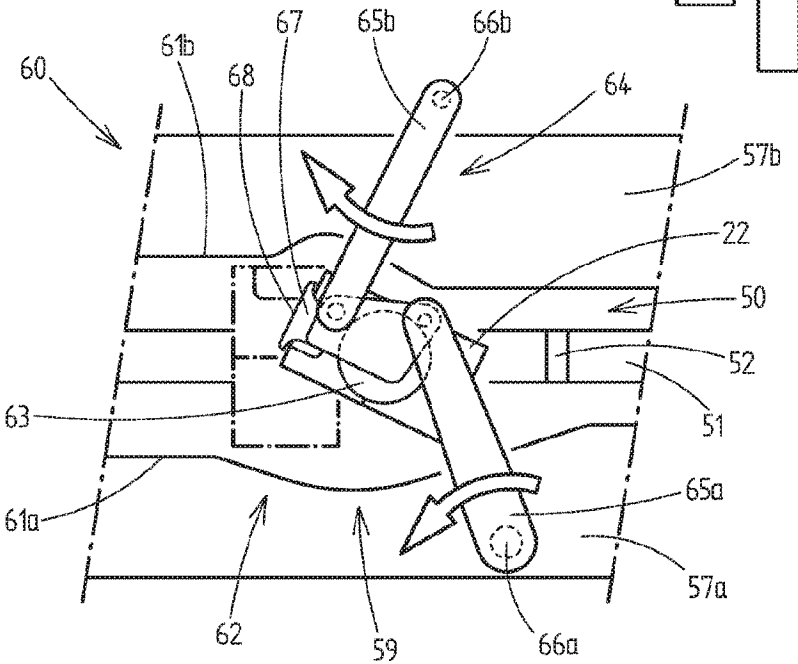
FIG. 12 shows the detail XII from FIG. 10 in an enlarged illustration.
Figure 13:
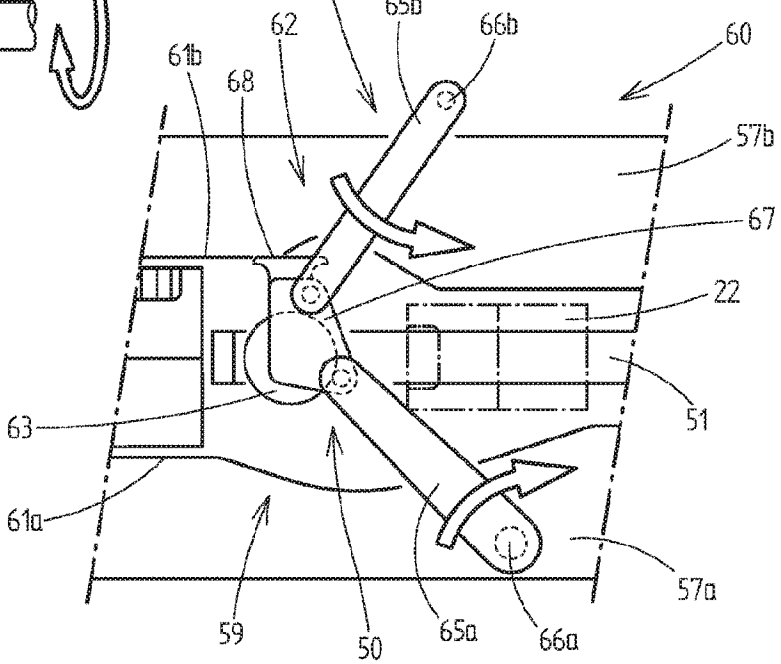
FIG. 13 shows the detail from FIG. 12 in a subsequent movement state.

By means of motor-driven pivoting of the pivot levers 65*a*, 65*b*, cf. FIGS. 12 and 13, about the pivot axes 66*a*, 66*b*, the support part 67 can be moved together with the holding member 63.

The pivot lever mechanism 64 is designed such that the holding member 63 can perform both rotational movements about axes of rotation running perpendicular to the conveying plane of the inner packs 22 and translational movements in a plane parallel to the conveying plane of the inner packs 22 (horizontal plane). In particular, translational movements with a movement component in the conveying direction or opposite thereto.

Here, in the process, each inner pack 22 conveyed into the region of the turning location 58 is firstly conveyed under the holding member 63 until it abuts (by way of the pack top side) against a front stop 68 arranged on the support part 67.

At this moment at the latest, the holding force of the holding member 63 is activated (in the present case, the holding member is charged with negative pressure), such that the holding member 63 grips the inner pack 22 by suction.

In this state in which it is gripped by suction or held, the holding member 63 is then initially accelerated to a certain degree in the conveying direction in order to withdraw it from the engagement of the conveying device 49 or from the contact with the corresponding driver 52. Subsequently or in an overlapping manner, a rotational movement of the holding member 63 occurs, cf. FIG. 12, until the inner pack 22 is oriented transversely or perpendicularly with respect to the conveying direction or conveying path 50.

When the pack is in the 90° position, the holding forces of the holding member 63 are deactivated, such that the inner pack 22 is released from the holding member 63 again. The inner pack 22 is then conveyed onward in the transverse orientation in relation to the conveying path 50.

Downstream of the first turning location 58, there is arranged a labeling station 69 at which the closure labels 25 are applied to the inner pack 22, such that the respective closure label 25 covers the respective removal opening 24, so as to form the sealing inner packs 26.

The labeling appliance 40 is arranged in the region of the labeling station 69. Said labelling appliance has a label conveyor 70 which is arranged perpendicular to the conveying plane (vertically) and which conveys individual closure labels 25 into an application region in which the inner packs 22 conveyed past under the label conveyor 70 are each equipped with the respective label 25.

In the present case, the label conveyor 70 is designed as a suction conveyor, such that the labels 25 are held on the conveying belt 71 of the label conveyor 70 by means of negative pressure during the transport to the application region.

The labels 25 originate in each case from labeling units 72*a* or 72*b*. Each labeling unit 72*a*, 72*b* has in each case one peel-off station 75 with in each case one peel-off member 73, for example a peel-off edge, by means of which individual labels 25 are peeled off from a label carrier strip 74 and are applied to the conveying belt 71.

The labels 25 applied in each case to the inner packs 22 in the application region must also be folded into a final position.

Figure 14:
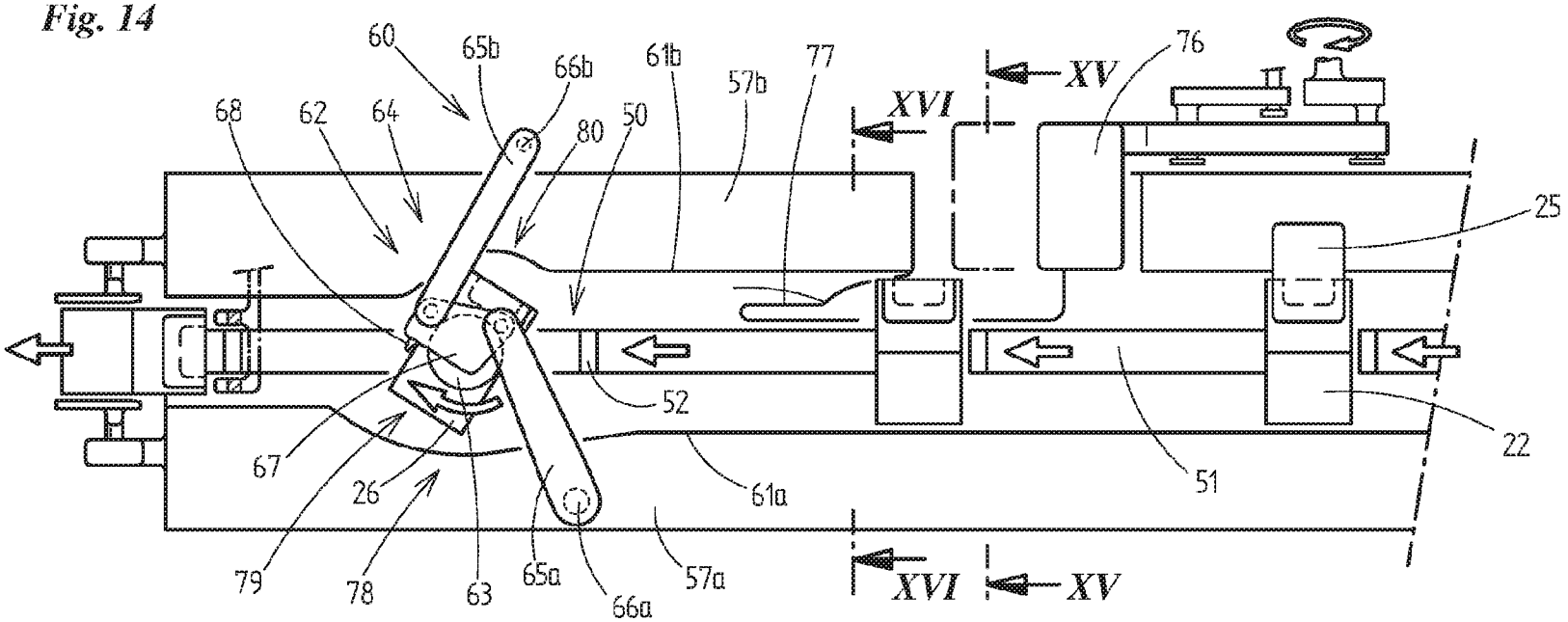
FIG. 14 shows a plan view of the section of the separable sealing inner pack unit from FIG. 8 corresponding to the viewing direction XIV in FIG. 8.
Figure 15:
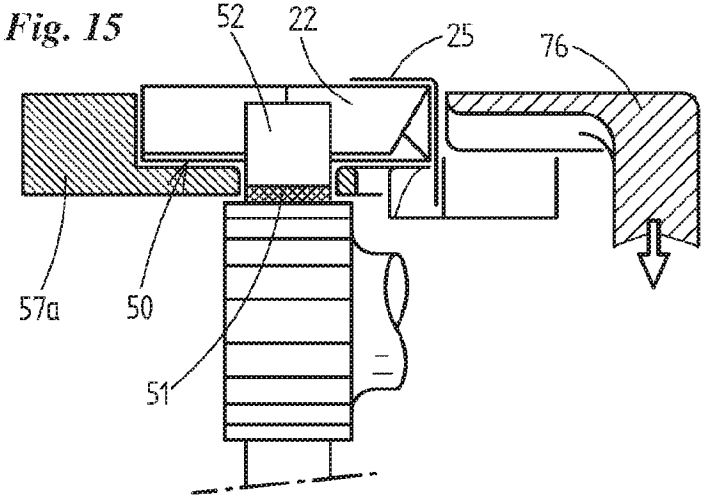
FIG. 15 shows a cross-sectional view along the cross-section line XV-XV in FIG. 14.

For this purpose, firstly, on one side of the conveying path 50, there is arranged a lateral, motor-driven label folding member 76, cf. FIG. 15, which folds an initially laterally protruding section, cf. FIG. 14, of the applied label 25 onto the top side, arranged transversely with respect to the conveying plane, of the inner pack 22.

Figure 16:
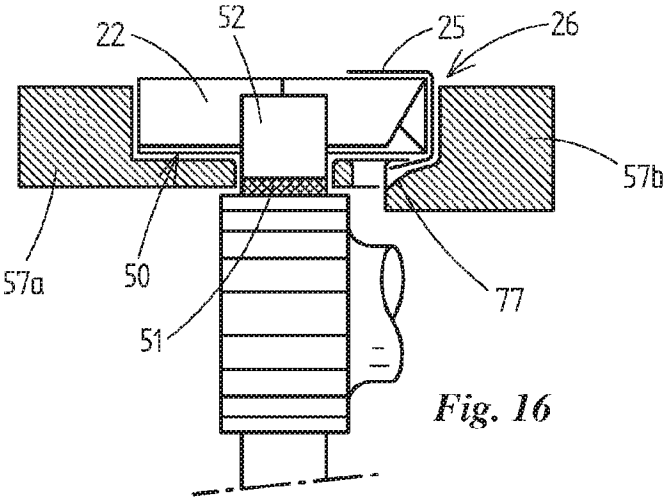
FIG. 16 shows a cross-sectional view along the cross-section line XVI-XVI in FIG. 14.

A stationary label folding member 77 is arranged downstream of the label folding member 76. Said stationary label folding member is designed as a folding switch and is part of the lateral guide 57*b*, cf. FIG. 16. Alternatively, an actively moving folding member could of course also be used for this.

Downstream of the labeling station 69, in particular downstream of the label folding switch 77, a second turning station 78 of the turning device 60 is arranged in the region of a further turning location 80. In order to create space for the rotating of the respective sealing inner pack 26, the guide surfaces 61*a*, 61*b* also have, in the region of the further turning location 80, a section in which they are spaced further apart than in the section immediately upstream of the turning location 80.

The second turning station 78 has, in the region of the second turning location 80, a turning appliance 79 with the same members and components as the turning appliance 62. Correspondingly, the same reference designations are used, cf. FIG. 14.

By means of the turning appliance 79, the respective inner pack 22 or the respective sealing pack 26 is turned or rotated once more through 90° relative to the conveying path 50, such that the two rotations in the two turning stations 59, 78 in each case through 90° result in a total rotation of the cigarette group 23 situated in the respective inner pack 22, or, downstream of the labeling station 69, in the sealing inner pack 26, by 180° relative to the conveying path 50.

Following or downstream of the turning location 80, the lateral guides 57*a*, 57*b* or their guide surfaces 61*a*, 61*b*, in a further section, run parallel again but with a somewhat smaller spacing than in the section upstream of the turning location 58, which approximately corresponds again to the width of the inner pack 22.

Overall, with the turning device 60, as already indicated above, the orientation of the cigarettes of the cigarette groups 23, which are fed to the separable sealing inner pack unit 14 within the inner packs 22 with cigarettes 29 oriented parallel to the conveying direction and filters 31 situated at the front in the conveying direction, is rotated in its orientation through 180°, such that said cigarette groups leave the separable sealing inner pack unit 14 again with cigarettes 29 likewise oriented parallel to the conveying direction but with filters 31 situated at the rear in the conveying direction.

Figure 17:
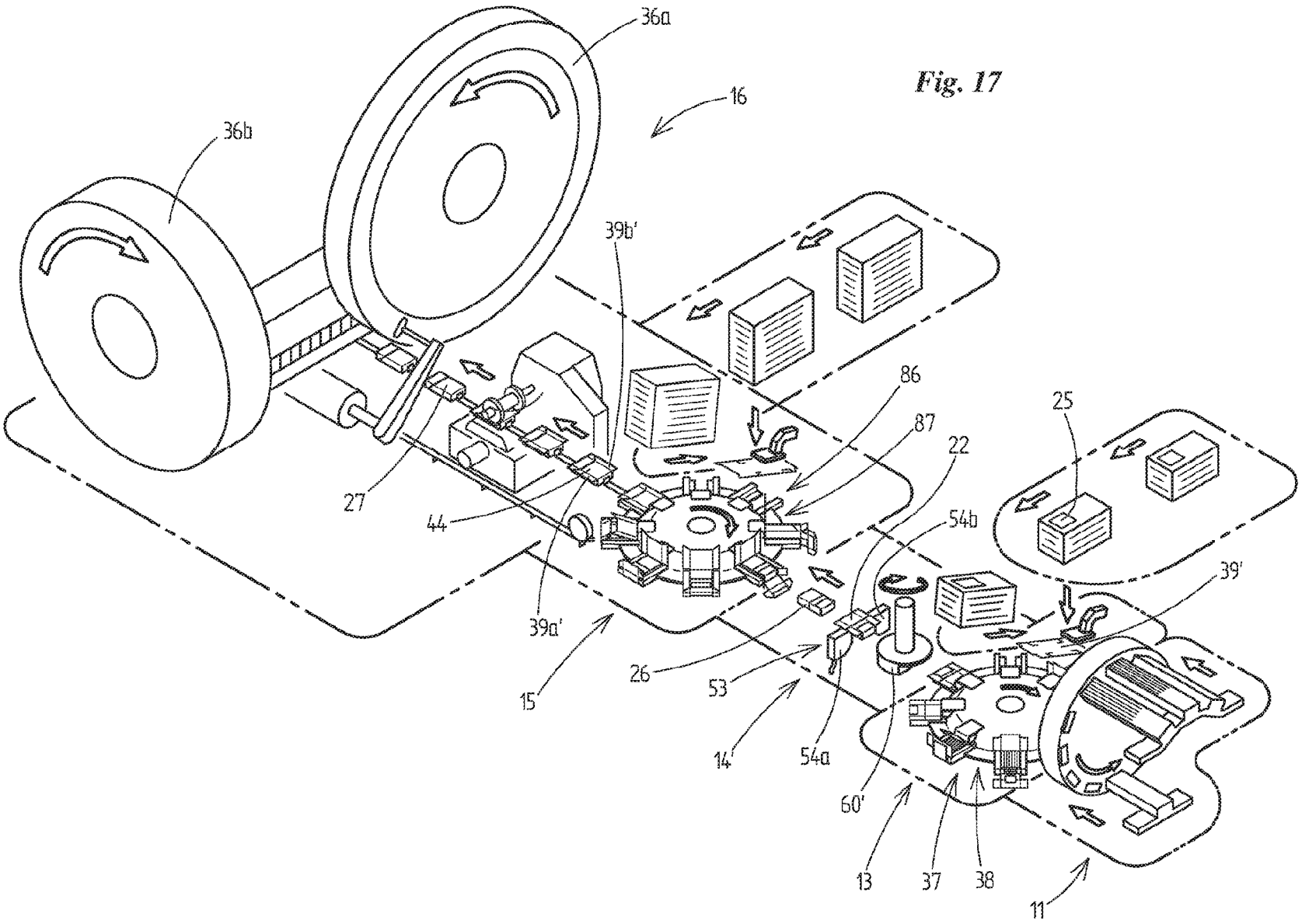
FIG. 17 shows a further configuration of the packaging machine for producing box-in-box packs corresponding to FIG. 3.

Finally, FIG. 17 shows a yet further alternative configuration of the packaging machine 10, in the case of which the separable sealing inner pack unit 14 has been replaced by an alternative sealing inner pack unit 14' which does not have a labeling appliance 40.

This is possible because the first separable folding unit 13 is fed with inner blanks 39' (composed of cardboard or some other dimensionally stable material suitable for forming a dimensionally stable inner pack) which have already been provided with a closure label 25 for what will later be the removal opening 24. These inner blanks 39' are conveyed to the folding revolver 38 of the first separable folding unit 13.

They may for example also originate from a separable manufacturing unit which is connected to the manufacturing line and which serves for the production of such blanks or blank stacks—blank-forming and stacking unit.

In the separable sealing inner pack unit 14', the side tabs 39*a*', 39*b*' then still have glue applied to them by means of the glue-applying unit 53 and the glue-applying valves 54*a*, 54*b*, and are folded into a final state.

Furthermore, in the sealing inner pack unit 14', the inner packs 22 or the sealing inner packs 26 formed therefrom are correspondingly turned/rotated by means of a turning device 60' in order to orient the cigarettes 29 in these packs correspondingly. In this case—because the labeling station 40 has been omitted—the rotating may also be performed directly through 180° in one operation.

A further special feature of the configuration of the packaging machine 10 in FIG. 17 is that the transfer unit 12 has been removed from the manufacturing line. The cigarette groups 23 emerging from the forming unit 11 are transferred directly to the first separable folding unit 13 or to its folding revolver 38.

It is self-evident that the above exemplary embodiments may be modified in a variety of ways without departing from the concept of the invention.

We expressly reserve the right to make each of the features mentioned above or in this application, where technically meaningful, individually or in any combination with others of the features above or mentioned in this application, the subject of a claim for protection.

LIST OF REFERENCE NUMBERS

10 Packaging machine
11 Manufacturing unit
12 Manufacturing unit
13 Manufacturing unit
14 Manufacturing unit
14' Manufacturing unit
15 Manufacturing unit
16 Manufacturing unit
17 Box-in-box
18 Box-in-box with tin foil partial wrapper
19 Box-in-box with complete tin foil wrapper
20 Sealed bundle packs
21 Sealed bundle packs
22 Inner pack
23 Cigarette group
24 Removal opening
25 Closure label
26 Sealing inner pack
27 Outer pack
28 Lid part
29 Cigarettes
30 Wrap
31 Filter
32 Collar
33 Carton part
34 Cigarette magazine
35 Blank
**36*a*** Curing revolver
**36*b*** Curing revolver
37 Folding device
38 Folding revolver
39 Inner blank
39' Inner blank
**39*a*** Side tabs
**39*b*** Side tabs
**39*a*'** Side tabs
**39*b*'** Side tabs
40 Labeling appliance
44 Outer blank
**44*a*** Side tabs
**44*b*** Side tabs
45 Collar unit
46 Foil wrapper, sealed bundle
47 Foil wrapper, sealed bundle
48 Closure label
49 Conveying device
50 Conveying path
51 Endless conveying belt
52 Driver
53 Glue-applying unit
**54*a*** Glue valve
**54*b*** Glue valve
55 Side tab folding unit
**55*a*** Side tab folding member
**55*b*** Side tab folding member
56 Folding parts
**57*a*** Lateral guide
**57*b*** Lateral guide
58 Turning location
59 Turning station
60 Turning device
60' Turning device
**61*a*** Guide surface
**61*b*** Guide surface
62 Turning appliance
63 Holding member
64 Pivot lever mechanism
**65*a*** Pivot lever
**65*b*** Pivot lever
**66*a*** Axis of rotation
**66*b*** Axis of rotation
67 Support part
68 Stop
69 Labeling station
70 Label conveyor
71 Conveying belt
**72*a*** Labeling unit
**72*b*** Labeling unit
73 Peel-off member
74 Label carrier strip
75 Peel-off station
76 Label folding member
77 Label folding member
78 Turning station
79 Turning appliance
80 Turning location
82 Blank magazine, inner blank
83 Blank magazine, outer blank
84 Wrapping material bobbin
85 Collar material web
86 Folding device
87 Folding revolver

The invention claimed is:

1. A packaging machine for producing packs with a group (23) of cigarettes as pack content, having individual separable manufacturing units (11-16) which are arranged adjacent to one another on a manufacturing line and which are separable from one another in each case in respective regions between each of the separable manufacturing units (11-16) and are removable from the manufacturing line as required, wherein the packaging machine can be converted from a first configuration, in which a first pack type can be manufactured, into a second configuration, in which a second pack type which differs from the first pack type can be manufactured, by removing at least one of the separable manufacturing units (11-16) from the manufacturing line, by replacing at least one of the separable manufacturing units (11-16) with another one of the separable manufacturing units (11-16) and/or by adding at least one further of the separable manufacturing units (11-16) to the manufacturing line, wherein the packaging machine, in the first configuration, has at least the following in succession in a manufacturing flow direction:

a separable forming unit (11) for forming cigarette groups;

a first separable folding unit (13) in which an inner blank composed of cardboard or of some other material suitable for forming a dimensionally stable inner pack is folded around the respective cigarette group (23) so as to form an inner pack (22);

a separable sealing inner pack unit (14) adjoining the first folding unit (13), in which a sealing inner pack (26) of a first type is formed in each case from the inner pack (22) or in which a sealing inner pack (26) of the first type is folded into a final state or in which in each case one sealing inner pack (26) of the first type comprising the inner pack (22) is formed, wherein the separable sealing inner pack unit (14) has a turning device (60, 60') which rotates the respective inner or sealing inner pack (22, 26) with the cigarette group (23) integrated therein within a conveying plane in which the cigarette group (23) is conveyed in the region of the turning device (60, 60'), or within a horizontal plane parallel thereto, through 180°, which can be in a single 180° rotation or in two 90° partial rotations;

a second separable folding unit (15), in which an outer blank composed of cardboard or of some other material suitable for forming a dimensionally stable outer pack is in each case folded around the sealing inner pack (26) of the first type in each case so as to form an outer pack (27); and a separable curing unit (16) adjoining the second separable folding unit (15), in which adhesive between folding tabs, which have been adhesively bonded to one another, of the respective outer blank of the outer pack (27) can cure.

2. The packaging machine as claimed in claim 1, wherein the packaging machine, in the second configuration, has at least the following in succession in the manufacturing flow direction:

the separable forming unit (11);

the first separable folding unit (13);

adjoining the first separable folding unit (13), instead of the separable sealing inner pack unit (14) for forming the sealing inner pack of the first type, another separable sealing inner pack unit for forming a sealing inner pack of a second type which differs from the sealing inner pack (26) of the first type;

adjoining the another separable sealing inner pack unit, the second separable folding unit (15), in which in each case one outer blank composed of cardboard or of some other material suitable for forming a dimensionally stable outer pack (27) is folded around the sealing inner pack of the second type; and adjoining the second separable folding unit (15), the separable curing unit (16).

3. The packaging machine as claimed in claim 1, wherein the packaging machine, in the second configuration, has at least the following in succession in the manufacturing flow direction:

the separable forming unit (11);

adjoining this the separable forming unit (11), a separable wrapping unit (12), in which a blank composed of wrapping material is folded around the cigarette group (23) so as to form a wrap which at least partially surrounds the cigarette group (23);

adjoining the separable wrapping unit (12) after removal of the first separable folding unit (13), and after removal of the separable sealing inner pack unit (14) for forming a sealing inner pack (26) of the first type, the second separable folding unit (15), in which an outer blank composed of cardboard or of some other material suitable for forming a dimensionally stable outer pack is folded around the cigarette group (23), which is at least partially surrounded by the wrapping material blank, so as to form the outer pack (27); and adjoining the second separable folding unit (15), the separable curing unit (16).

4. The packaging machine as claimed in claim 1, wherein, between the separable forming unit (11) and the first separable folding unit (13), and adjoining each of these, there is arranged a separable transfer unit (12), which conveys the respective cigarette groups (23) from the separable forming unit (11) to the first separable folding unit (13).

5. The packaging machine as claimed in claim 4, wherein the separable transfer unit (12) additionally at least partially wraps the cigarette groups (23) in a blank composed of wrapping material in such a way that the respective wrapping material blank is folded in a cup-like or U-shaped manner around the respective cigarette group (23), such that the wrapping material blank does not cover the filters of the cigarettes (29) at least in their end region.

6. The packaging machine as claimed in claim 1, wherein, in a respective one of the regions between in each case two of the separable manufacturing units (11-16), in each case one conveying member of one of the separable manufacturing units (11-16) is arranged adjacent to a conveying member of the other of the separable manufacturing units (11-16), specifically such that the respective cigarette groups can be transferred from one conveying member to the other conveying member.

7. The packaging machine as claimed in claim 1, wherein the first separable folding unit (13) and/or the second separable folding unit (15) comprises a respective folding revolver which folds the inner blank around the cigarette group (23) so as to form the inner pack (22) and/or which folds the outer blank in each case around the sealing inner pack (26) so as to form the outer pack (27).

8. The packaging machine as claimed in claim 7, wherein the folding revolver of the first separable folding unit (13) and/or the folding revolver of the second separable folding unit (15) has a respective horizontal plane of revolution.

9. The packaging machine as claimed in claim 1, wherein the first separable folding unit (13) and the second separable folding unit (15) are of substantially identical form.

10. The packaging machine as claimed in claim 1, wherein the separable sealing inner pack unit (14) has a conveying device which conveys the respective inner or sealing inner pack (22, 26), with cigarettes (29) oriented parallel to the conveying direction, into the region of the turning device (60, 60').

11. The packaging machine as claimed in claim 1, wherein the sealing inner pack (26) is in each case a separate pack, sealed on all sides and at least partially composed of foil with a removal opening covered by a closure label, which completely envelops the respective inner pack (22) together with the cigarette group (23), or in that the sealing inner pack (26) is a pack sealed on all sides and formed or created from the respective inner pack (22), in the case of which one or each opening of the respective inner pack (22) is covered over its entire area with a closure label (25).

12. The packaging machine as claimed in claim 11, wherein the or each label (25) which covers the opening is applied to the inner pack (22) in the separable sealing inner pack unit (14).

13. The packaging machine as claimed in claim 12, wherein the or each label (25) which covers the opening is applied to the inner pack (22) in the separable sealing inner pack unit (14) after or downstream of a rotation of the inner pack (22) by the turning device (60, 60').

14. The packaging machine as claimed in claim 1, wherein the inner blank which is folded around the cigarette group (23) in the first separable folding unit (13) is, already before the folding process, provided with a closure label (25) which is arranged so as to cover a removal opening of the subsequent sealing inner pack (26).

15. The packaging machine as claimed in claim 1, wherein the separable manufacturing units (11-16) have in each case at least one dedicated servomotor for driving at least one movable conveying member of the manufacturing unit, or in that at least two of the separable manufacturing units (11-16) are assigned in each case one common servomotor for driving movable members of the separable manufacturing units (11-16), wherein only one of these at least two separable manufacturing units (11-16) has the servomotor, and wherein at least one movable member of the separable manufacturing unit (11-16) which does not have the servomotor is connected via a transmission to the servomotor of the other separable manufacturing unit (11-16) which has the servomotor.

16. The packaging machine as claimed in claim 1, wherein, in the sealing inner pack unit (14), one or more side tabs of the inner pack (22) are provided with adhesive and are folded, and/or in that, in the curing unit (16), one or more side tabs of the outer pack (27) are provided with adhesive and are folded.

17. The packaging machine as claimed in claim 16, wherein the one or more side tabs of the inner pack (22) are folded into a final state, and/or the one or more side tabs of the outer pack (27) are folded into a final state.

18. A method for converting a packaging machine for producing packs with a group of cigarettes as pack content as claimed in claim 1 from the first configuration, in which the first pack type can be manufactured, into the second configuration, in which the second pack type which differs from the first pack type can be manufactured, by virtue of at least one of the separable manufacturing units (11-16) being removed from the manufacturing line, by virtue of at least one of the separable manufacturing units (11-16) in the manufacturing line being replaced by another of the separable manufacturing units (11-16), and/or by virtue of at least one further of the separable manufacturing units (11-16) being added to the manufacturing line.

19. The method as claimed in claim 18, wherein, for the conversion of the packaging machine into the second configuration, the separable sealing inner pack unit (14) for the formation of the sealing inner pack (26) of the first type is removed from the manufacturing line and is replaced by another separable sealing inner pack unit (14) for the formation of a sealing inner pack (26) of the second type, which differs from the sealing inner pack (26) of the first type.

20. The packaging machine as claimed in claim 1, wherein the individual separable manufacturing units (11-16) which are arranged adjacent to one another on the manufacturing line are non-destructively separable from one another.

* * * * *